US006296138B1

(12) United States Patent
Hannah et al.

(10) Patent No.: US 6,296,138 B1
(45) Date of Patent: Oct. 2, 2001

(54) CONTAINER LINER AND LINING SYSTEM

(75) Inventors: Sue Hannah, Newark, OH (US); Barbara A. Sherman, Chambersburg, PA (US)

(73) Assignee: The Longaberger Company, Newark, OH (US)

( * ) Notice: Subject to any disclaimer, the term of this patent is extended or adjusted under 35 U.S.C. 154(b) by 0 days.

(21) Appl. No.: 08/862,275

(22) Filed: May 23, 1997

(51) Int. Cl.[7] ..... B65D 25/16; B65D 35/14; B65D 90/04

(52) U.S. Cl. ..... 220/495.08; 150/112; 150/129; 229/23.9; 229/23.91

(58) Field of Search ..... 220/9.1, 9.4, 495.1, 220/495.06, 495.08, 495.11, 23.9, 23.91, 528, 62.14, 62.21, 495.03, 908.1, 908.3, 909; 150/112, 113, 116, 129; 383/33, 38, 40, 119

(56) References Cited

U.S. PATENT DOCUMENTS

| | | | | |
|---|---|---|---|---|
| 0,560,469 | * | 5/1896 | Butts et al. | 383/40 |
| 1,305,797 | * | 6/1919 | Henderson | 383/40 |
| 1,421,628 | * | 7/1922 | Watkins | 220/495.01 |
| 3,734,340 | * | 5/1973 | Ippolito et al. | 220/495.11 |
| 3,915,329 | * | 10/1975 | Zaks | 383/119 X |
| 3,957,195 | * | 5/1976 | Lin | 383/119 X |
| 4,117,874 | * | 10/1978 | Berenguer | 383/40 |
| 4,138,054 | * | 2/1979 | Spencer | 383/119 X |
| 4,457,483 | * | 7/1984 | Gagne | 383/119 X |
| 4,585,159 | * | 4/1986 | Travis | 220/9.4 |
| 5,020,673 | * | 6/1991 | Adams | 150/112 |
| 5,152,612 | * | 10/1992 | Shoemaker | 383/40 |
| 5,253,775 | * | 10/1993 | Gould | 220/495.06 |
| 5,490,619 | * | 2/1996 | Boyar | 150/112 X |
| 5,598,942 | * | 2/1997 | Cowie | 220/495.01 |
| 5,788,032 | * | 8/1998 | Krulik | 190/108 |

OTHER PUBLICATIONS

The Longaberger Company, *WishList,* Sep. 1995, p. 13, and Spring & Summer 1996, p. 17, Over–the–Edge Fabric Basket Liner (shown with Magazine Basket).

* cited by examiner

*Primary Examiner*—Gregory M. Vidovich
*Assistant Examiner*—Niki M. Eloshway
(74) *Attorney, Agent, or Firm*—Porter, Wright, Morris & Arthur LLP

(57) ABSTRACT

A liner and lining system for use with an upwardly-opening container, in which the liner includes a storage receptacle such as a pocket. The lining system comprises a liner body received within the container and an insert received within the liner body. The liner body includes a flap with a storage receptacle. The flap extends from the body, folds over the top portion of the insert and hangs into the interior of the insert. The insert anchors the liner body in a desired position within the container. The engagement of the insert by the flap further assists in maintaining the liner body in a desired position and preventing the liner body from sagging when items are placed in the storage receptacle.

12 Claims, 5 Drawing Sheets

CONTAINER LINER AND LINING SYSTEM

BACKGROUND OF THE INVENTION

The present invention relates to a liner for an upwardly-opening container or vessel, and more particularly, to a liner having a storage receptacle, such as a pocket.

Liners frequently are used inside containers to prevent contact between the contents of the container and the inner surface of the container, or to provide a softer or smoother surface within the container. When the container has interstices or perforations, a liner also may provide a barrier to the passage of liquids or small objects such as coins or paper clips through these container openings. Liners also may increase the usefulness of the container by providing compartments for convenient storage of small items.

Liners frequently are used with baskets, and particularly upwardly-opening baskets, to achieve one or more of these purposes. Fabric "drop-in" liners, which are not secured to the container, are common, as are other liner styles that fold over the top rim of the container or otherwise are secured to the container. Many of these liners, and particularly drop-in liners, are susceptible to being shifted out of position, or even disassociated entirely from the container when the container is handled, especially when objects are inserted into or removed from the container. When pockets are provided in these liners, the liners also are susceptible to sagging or even collapsing when the pockets are filled with large or heavy items. This has, unfortunately, tended to limit the number and size of the pockets provided, and thus, the usefulness of the liners.

Often, more than one liner is used within a basket to form a lining system with desired qualities. For example, a fabric liner may be combined with a water-impermeable protective liner or shell. The shell may be used inside of the fabric liner or between the fabric liner and the container. Using the shell inside the fabric liner not only protects the fabric liner from being soiled or damaged by abrasion, punctures or the like, but also tends to support the fabric liner in an upright position within the container, thereby preventing the fabric liner from sagging or shifting out of position. However, this arrangement generally precludes the usefulness of storage receptacles such as pockets or the like provided in the fabric liner. If the shell is interposed between the fabric liner and the container, the storage compartments of the fabric liner are accessible, but the fabric liner is likely to shift or sag if it is not supported within or securely fastened to the container.

SUMMARY OF THE INVENTION

It is an object of the present invention to provide a liner for use with an upwardly-opening container in which the liner is supported by an insert received within the container while allowing access to a storage receptacle on the liner.

It is another object of the present invention to provide a lining system comprising a liner including a storage receptacle and a liner insert. As described above, the insert provides support for the liner while allowing access to a storage receptacle on the liner.

The foregoing objective are achieved in a liner including a liner body that is interposed between the interior of the container and the exterior of an insert. A flap with a storage receptacle on it extends from the body, folds over the top portion of the insert and hangs into the interior of the insert. The engagement of the insert by the flap assists in maintaining the liner in a desired position, particularly when objects are placed in the storage receptacle on the flap.

The liner may include a base and side walls. Preferably, the liner is flexible and is shaped to conform substantially to the interior of the container. The top of the liner side walls may end at about the same level as, or a short distance below, the container walls. In another embodiment, the liner body may include a cuff that folds over the top rim of the container and covers a portion of the exterior of the container. If the container has a handle mounted to its exterior, the cuff may define a recess to accommodate the handle. The liner body may be secured to such a container by fasteners provided on tabs that extend from opposing sides of the recess below the container handle.

The flap may extend from the liner body at or below the vicinity of the top edge of the insert, which typically is positioned at a distance below the top of the container walls. The storage receptacle is positioned on the portion of the flap that hangs into the interior of the insert. This receptacle preferably will take the form of a pocket, with or without closures, gussets, or viewing windows. The receptacle also may take other forms, such as a loop suitable for holding items such as pens or key chains in place.

The invention also encompasses a lining system including a liner body and a liner support or insert. The liner insert defines a base and side walls that terminate at a distance below the top of the container walls. The liner body is interposed between the interior of the container and the exterior of the insert. As described above, the liner body includes a flap that hangs over a top edge the insert and into the interior of the insert The insert anchors the liner body in a desired position within the container and possesses sufficient stiffness to secure the liner body in an upright position.

These and further objects of the invention will become apparent from the following detailed description.

DETAILED DESCRIPTION OF THE INVENTION

The present invention comprises a liner and lining system for use with an upwardly-opening container, in which the liner includes a storage receptacle, such as a pocket. The liner and lining system of the present invention may be used with containers without lids, as well as those with separate or attached lids. Particular embodiments of the invention may be described with reference to containers that are baskets, although the liner and lining system may be used satisfactorily with other types of containers as well. The invention comprises a liner for use with an upwardly-opening container and a container insert received within the container, as well as a lining system that includes both a liner and a liner insert or support.

Figure 1:
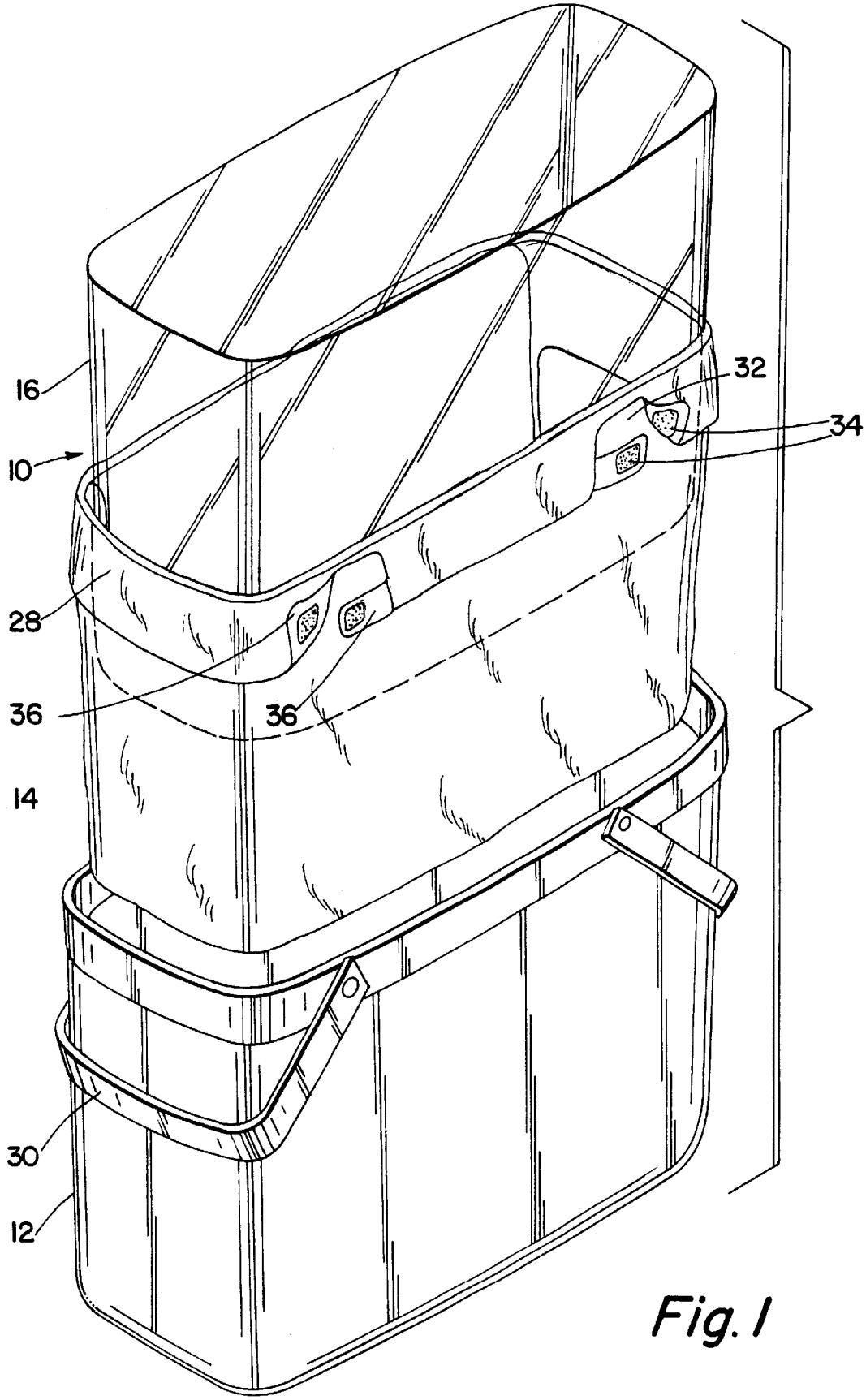
FIG. 1 is an exploded perspective view of the liner insert and liner body that comprise the lining system of the present invention and an upwardly-opening container (not part of the invention) with which the lining system may be used, showing that the insert is received within the liner body which in turn is received within the container.
Figure 2:
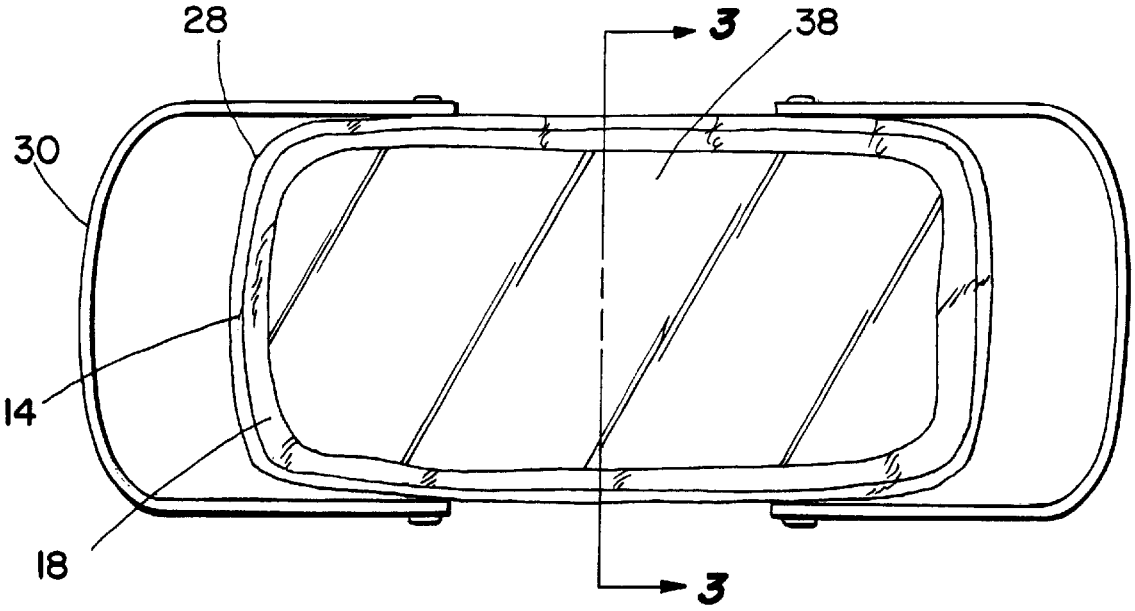
FIG. 2 is atop view of the lining system of the present invention received within the container of FIG. 1.

Turning now to the drawings, FIG. 1 shows a lining system 10 for use with an upwardly-opening container 12. The system 10 includes a liner body 14 received within the container 12 and a liner insert 16 which in turn is received within the liner body 14. FIGS. 3, 4, 6 and 7 all show tat when the lining system 10 is in place within the container 12,12' the liner body 14,14' is interposed between the interior of the container 12,12' and the exterior of the insert 16,16'.

Figure 3:
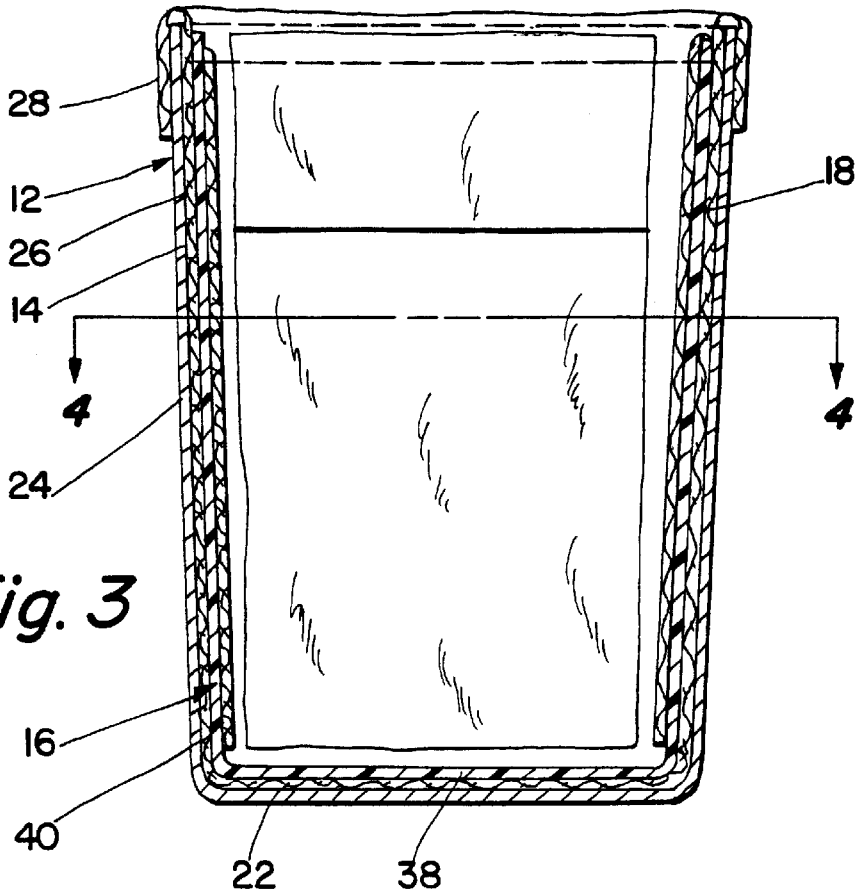
FIG. 3 is a side sectional view of the lining system and container of FIG. 2 along line 3—3.
Figure 4:
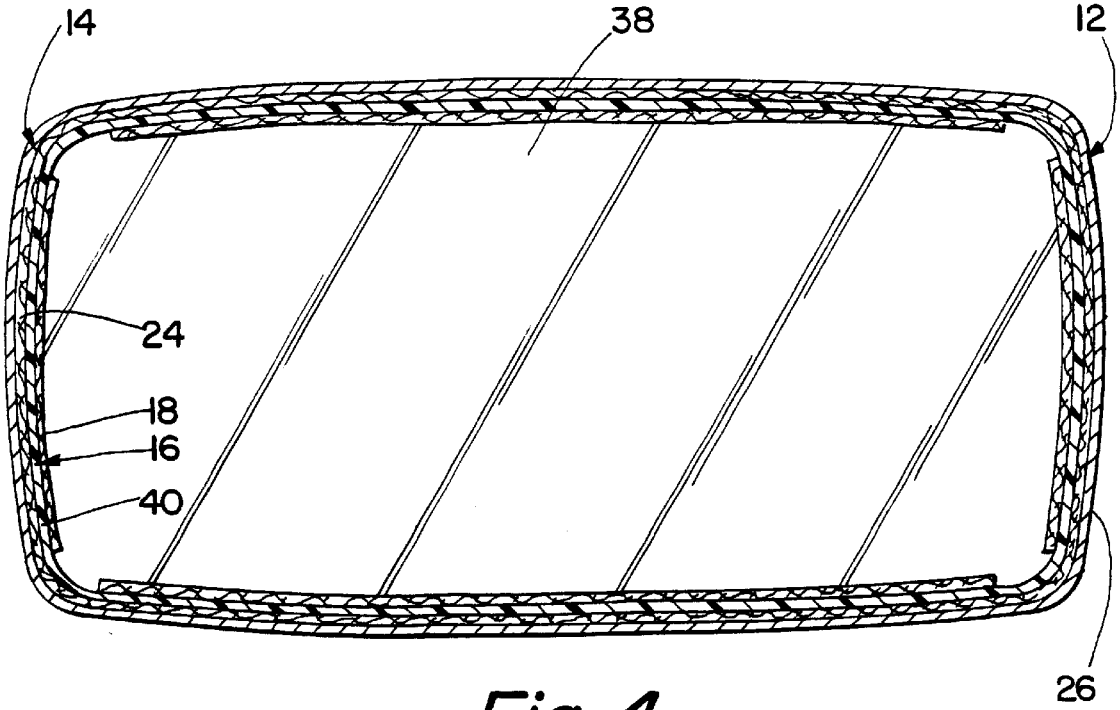
FIG. 4 is a top sectional view of the lining system and container of FIG. 2 along line 4—4.
Figure 6:
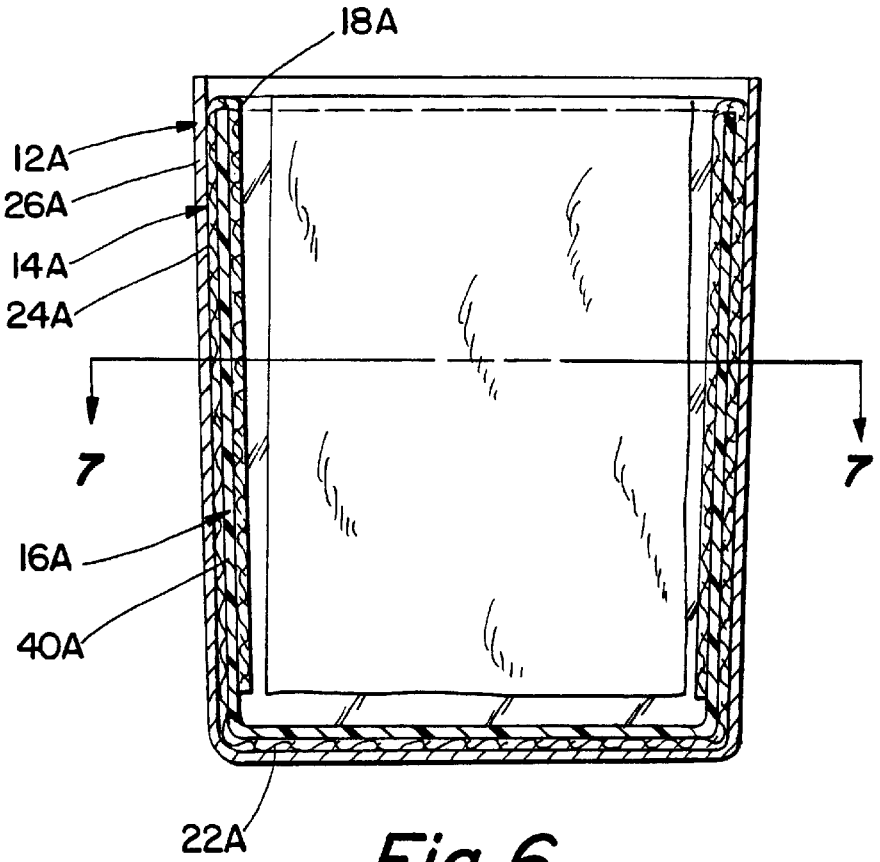
FIG. 6 is a side sectional view of the lining system and container of FIG. 5 along line 6—6.

The liner body 14,14' is shaped to conform substantially to the interior of the container 12,12' and generally includes a base 22,22' and side walls 24,24'. The top of the side walls 24,24' may end at about the same level as, or a short distance below, the top of the container walls. 26,26' as shown in FIG. 6. Alternatively, as shown in FIGS. 1 and 3, the liner body 14 may include a cuff 28 that folds over the top rim of the container 12 and covers a portion of the exterior of the container 12. The embodiment of the liner body without the cuff generally is more suitable for use with lidded containers because the height of the liner body may be adjusted so that it ends below the part of the container that comes into contact with the lid. However, the cuffed liner body also may be used with a lid if the lid does not extend into the interior of the container or if the lid is sized so that it does not bind when it comes into contact with the liner body.

If the container 12 has a handle 30 mounted to its exterior, as shown in FIG. 1, the cuff 28 may define a recess 32 to accommodate the handle 30. The liner body 14 may be secured to the container 12 by fasteners 34 provided on tabs 36 that extend from opposing sides of the recess 32 below the handle 30. The fasteners 34 may be hook and loop fasteners, buttons and buttonholes, snaps, ties, or any other items suitable for releasably fastening the tabs 36 together.

A flap 18,18' extends from the liner body 14,14' folds over the top portion of the insert 16,16' and hangs into the interior of the insert 16,16'. The flap 18,18' may hang nearly to the base 22,22' of the liner body 14,14' as is shown in FIGS. 3 and 6, or it may end at a desired distance above the base 22 (not shown in the drawings). The flap 18 includes a storage receptacle 20, such as the pocket shown in FIG. 8, on the portion that hangs into the interior of the insert 16 so that the receptacle 20 is accessible when the insert 16 is in place within the liner body 14.

The liner body and flap preferably are formed from a flexible, lightweight material, most typically, fabric. Other materials having similar characteristics, such as plastic mesh, also may be suitable. The liner body is constructed by conventional methods such as those well known in the field of fabric linings for baskets. Preferably, the body is constructed so that it will substantially conform to the interior of the container, although the presence of some excess fabric in the liner body is unlikely to have a marked effect on performance unless the fabric is unusually heavy or stiff. Preferably, the fabric is oriented so that the "wrong" side, if any, faces the container interior to provide a more attractive appearance when looking into the container, and the edges are finished, by hemming, binding, or similar techniques. The liner body also may be provided with a lining so that the wrong side of the fabric is not exposed and all of the seams and edges have a finished appearance.

The flap 18 may be integral with the liner body 14 or formed from a separate piece of fabric and securely sewn or otherwise attached to the liner body 14. If desired, the flap 18 may be made from a different fabric than the liner body 14, although use of the same fabric or one with similar characteristics, such as composition, weight and body, will yield superior results. Preferably, the flap 18 extends from the wall 24 of the liner body 14 from a position at about the same height as the top edge of the insert 16, or lower. If the flap 18 extends from a much higher position on the liner wall 24, the portion of the liner body 14 above the insert 16 is likely to buckle or gap when items are placed in the storage receptacle 20. Flaps 18 may be provided on one or more walls 24 of the liner body 14, and more than one flap may even be provided on a single wall 24. The flaps 18 may vary in size and include different types and sizes of receptacles 20.

Figure 8:
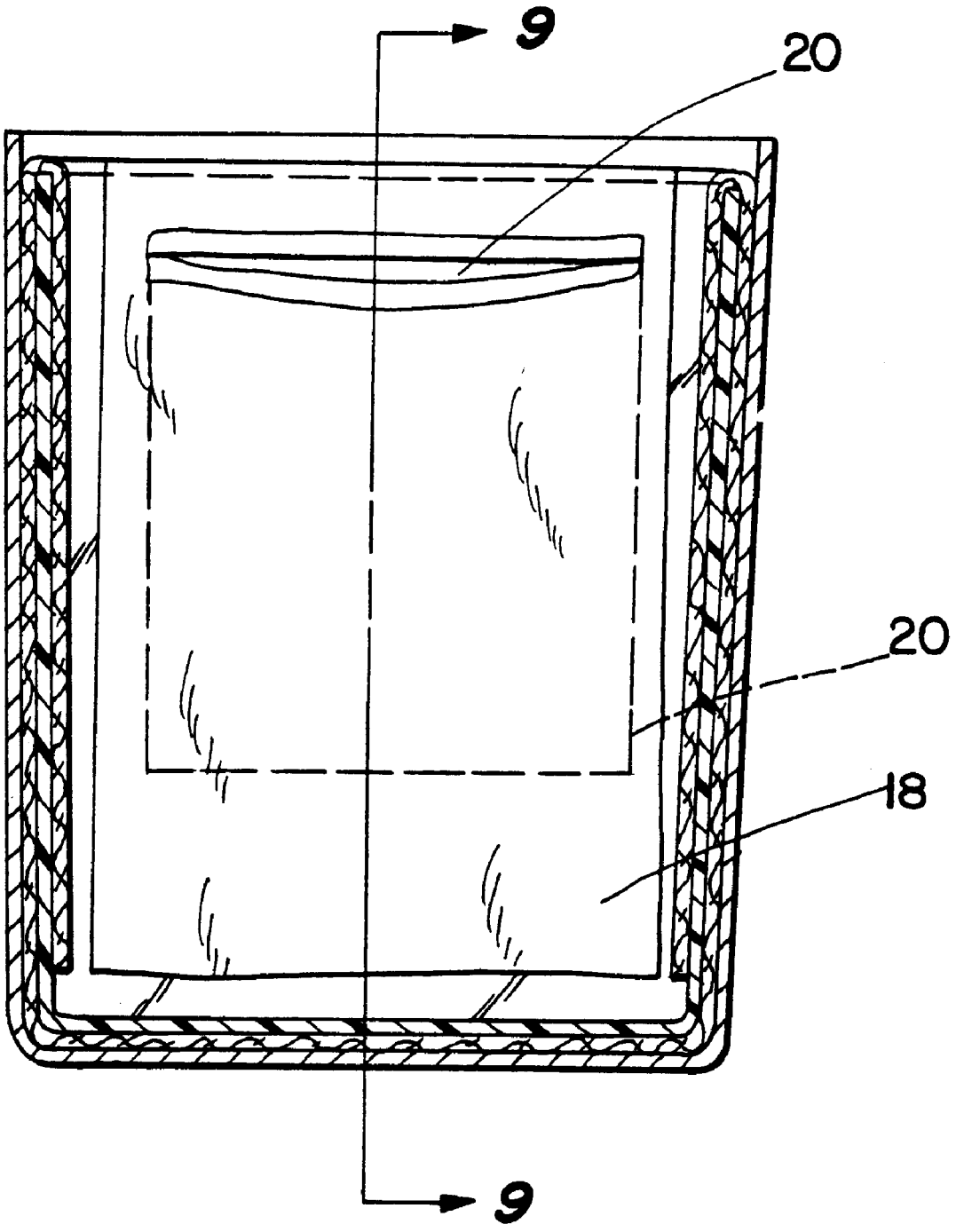
FIG. 8 is a detail front view of a portion of a flap of the lining body showing a storage receptacle in the form of a pocket.

The storage receptacle 20 generally will take the form of a pocket, as shown in FIG. 8. The pocket may extend for substantially the full width of the flap 18 or only a part of this width. The pocket may be open or provided with a suitable closure such as a zipper, button and buttonhole or loop, snap fasteners, or the like. If desired, the pocket may be fashioned with gussets to provide greater storage space. A transparent or mesh viewing window may be provided in the pocket to allow a user to see or display the pocket contents, such as change, a driver's license or a photo. The receptacle 20 also may take other forms, such as a loop (formed from fabric, plastic, metal, or any other appropriate material) suitable for holding items such as pens, key chains, or the like in place.

The liner insert 16,16' defines a base 38,38' and side walls 40,40' that terminate at a distance below the top of the container walls 26,26'. The insert 16,16' anchors the liner body 14,14' in a desired position within the container 12,12' and possesses sufficient stiffness to secure the liner body 14,14' in an upright position. Preferably, the insert 16,16' is molded or otherwise formed from a single, seamless piece of plastic using methods well known in the manufacture of plastic containers. Other materials and/or methods of construction also may be suitable for making inserts. Most preferably, the insert 16 is transparent and colorless so that the material of the liner body 14 is visible through the insert 16 when looking into the bottom of the container, but this is not required to achieve the desired function.

Figure 5:
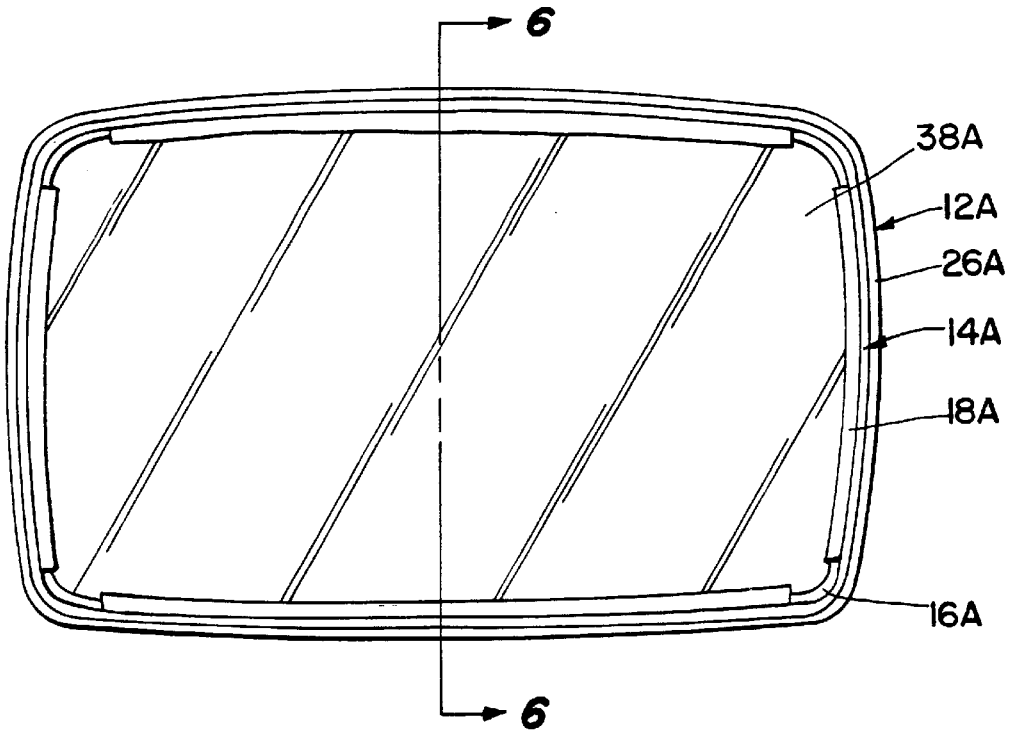
FIG. 5 is a top view of another embodiment of the lining system received within a container without handles.
Figure 7:
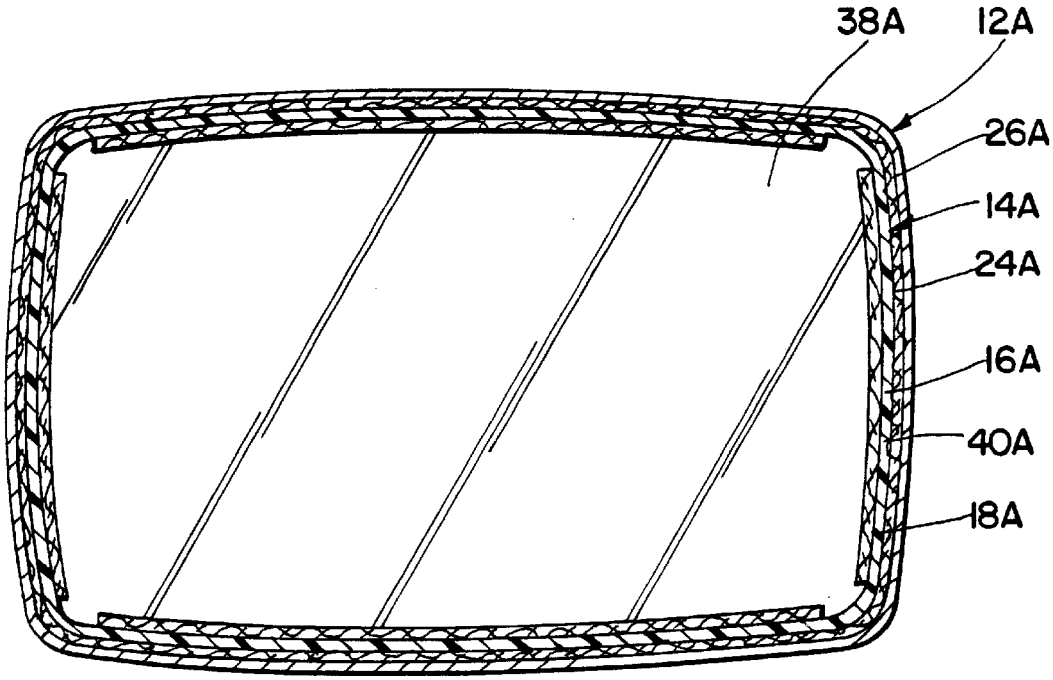
FIG. 7 is a top sectional view of the lining system and container of FIG. 5 along line 7—7.

When the liner body 14 is sandwiched between the container 12 and the insert 16, the insert 16 tends to maintain the liner body 14 in an upright position within the container 12, even if the liner body 14 is not fastened to the container 12 in any way (as is the case with the lining system shown in FIGS. 5–7). The flap 18 and its storage receptacle 20 form a "saddlebag" that hangs over the top edge of the insert 16 into its interior. This provides ready access to the storage receptacle 20 of the liner body 14 even though most of the liner body 14 is covered by the insert 16. The engagement of the insert 16 by the flap 18 further assists in maintaining the liner body 14 in a desired position, particularly when objects are placed in the receptacle 20.

Although specific embodiments of the invention have been described herein in detail, it is understood that variations may be made thereto by those skilled in the art without departing from the spirit of the invention or the scope of the appended claims.

What is claimed is:

1. A lining system for use with an upwardly-opening container having a base and side walls, comprising:

a container insert having a base and side walls that terminate at a distance below the top of the container walls, and a liner including:

a liner body having a base and side walls, the liner body receivable within the container and the insert receivable within the liner body;

a first flap extending from a side wall of the liner body; and a second flap extending from an opposing side wall of the liner body, each of the flaps folding over a top edge of the insert and hanging into the interior of the insert, at least one of the flaps defining a storage receptacle.

2. The lining system according to claim 1, wherein the storage receptacle is located on the portion of the flap that hangs into the interior of the insert.

3. The lining system according to claim 1, wherein the flap extends from a portion of the liner body in the vicinity of the top edge of the insert.

4. The lining system according to claim 1, wherein the liner body is placed between the interior surface of the container and the exterior surface of the insert.

5. A lining system for an upwardly-opening container, comprising:

a flexible liner body receivable within the container and shaped to conform substantially to the interior of the container, the liner body including a flap, the flap defining a storage receptacle, the liner body further including a cuff that folds over the top rim of the container and covers a portion of the exterior of the container; and a liner support removably receivable within the liner body, the flap being folded over a top edge of the liner support into the interior of the liner support.

6. The lining system according to claim 5, wherein the cuff defines a recess to accommodate a handle mounted to the container exterior.

7. The lining system according to claim 6, wherein the liner body is secured to the container by fasteners provided on tabs on the cuff portion that extend from opposing sides of the recess below the container handle.

8. The lining system according to claim 5, wherein the liner support anchors the liner body in a desired position within the container.

9. The lining system according to claim 5, wherein the liner support possesses sufficient stiffness to secure the liner body in an upright position within the container.

10. The lining system according to claim 5, wherein the liner support is moisture resistant.

11. The lining system according to claim 5, wherein the liner support is water impermeable.

12. A lining system for an upwardly-opening container, comprising:

an insert receivable within the container, the insert having a base and side walls that terminate at a distance below the top of the container walls; and a liner body placed between the interior surface of the container and the exterior surface of the insert, the liner body including a flap hanging over a top edge of the insert and into the interior of the insert, the flap defining a storage receptacle located on the flap surface opposite the interior surface of the corresponding insert side wall.

* * * * *